United States Patent [19]

Sanchez-Caldera et al.

[11] Patent Number: 4,999,050

[45] Date of Patent: Mar. 12, 1991

[54] DISPERSION STRENGTHENED MATERIALS

[75] Inventors: Luis E. Sanchez-Caldera, Hudson; Arthur K. Lee, Clinton; Nam P. Suh, Sudbury; Jung-Hoon Chun, Hopedale, all of Mass.

[73] Assignee: Sutek Corporation, Hudson, Mass.

[21] Appl. No.: 238,356

[22] Filed: Aug. 30, 1988

[51] Int. Cl.[5] ..... C22C 29/14

[52] U.S. Cl. ..... 75/244; 419/23; 419/25; 419/33; 419/34; 419/12; 419/30

[58] Field of Search ..... 75/244, 951, 246; 419/45, 12; 428/539.5; 420/590, 129

[56] References Cited

U.S. PATENT DOCUMENTS

| | | | |
|---|---|---|---|
| 3,779,714 | 12/1973 | Nadkarni et al. | 75/232 |
| 3,884,676 | 5/1975 | Nadkarni et al. | 75/0.5 |
| 3,893,844 | 7/1975 | Nadkarni | 75/0.5 |
| 4,056,644 | 8/1977 | Shafer et al. | 29/187.5 |
| 4,077,816 | 3/1978 | Nadkarni | 75/232 |
| 4,274,873 | 6/1981 | Nadkarni | 75/211 |
| 4,315,770 | 2/1982 | Nadkarni | 75/9.5 |
| 4,419,130 | 12/1983 | Slaughter | 75/244 |
| 4,440,572 | 4/1984 | Nadkarni et al. | 75/232 |
| 4,478,787 | 10/1984 | Nadkarni et al. | 419/8 |
| 4,576,653 | 3/1986 | Ray | 148/3 |
| 4,588,870 | 5/1986 | Nadkarni et al. | 219/119 |
| 4,744,947 | 5/1988 | Nilmen et al. | 420/590 |
| 4,752,334 | 6/1988 | Nadkarni et al. | 75/235 |
| 4,836,982 | 6/1989 | Brupbacher et al. | 420/129 |

*Primary Examiner*—Stephen J. Lechert, Jr.
*Assistant Examiner*—Nina Bhat
*Attorney, Agent, or Firm*—Robert F. O'Connell

[57] ABSTRACT

This invention relates generally to materials and processes for making materials and, more particularly, to high performance boride dispersion strengthened materials, including alloy-modified, boride dispersion strengthened materials and techniques for making such materials.

13 Claims, 2 Drawing Sheets

MAGNIFICATION = x 100,000

0.1 MICRON

DISPERSION STRENGTHENED MATERIALS

BACKGROUND OF THE INVENTION

Ultra-fine and stable refractory particles, if properly distributed within a metal matrix, impart excellent microstructural stability to the matrix even at temperatures up to as high as 0.9 of the absolute melting point ($T_m$) of the metal. As used herein, the term ultra-fine particle shall be deemed to mean a particle, the volume of which approximates the volume of a sphere having a diameter which is less than 0.1 micron. These materials, comprising a metal matrix and an ultra fine dispersion of high thermal stability particles, as exemplified by the refractory ceramics, are referred to in the art as dispersion-strengthened (DS) materials. Such materials have excellent strength retention capability at and after elevated temperature exposures. In spite of their unique characteristics (i.e., strength and stability at high temperatures), the effective commercialization of such DS materials has been slow, mainly due to the high processing cost associated with the manufacturing of useful DS materials.

In dispersion strengthened copper, for example, the majority of the DS copper materials utilize a refractory oxide as the dispersoid (sometimes referred to as ODS copper). Various techniques have been developed to process oxide dispersed copper. Most of these techniques utilize the copper and oxide materials in a powdered form as the starting materials, and they differ mainly in the method by which the oxide powder particles are introduced into the copper powder matrix. Among the various processing methods currently available, those which provide ODS copper by the use of an internal oxidation (IO) processing technique seem to have gained the most popularity. It has been demonstrated that IO ODS copper has superior mechanical properties over oxide DS copper materials manufactured by other known processing methods. Such superior properties, however, are achieved at a penalty inasmuch as making ODS copper using an IO technique is a very tedious and time consuming process, which factors contribute to the very high processing costs thereof. Consequently, industrial applications of ODS copper have not been very wide spread.

While, for purposes of clarity, concepts relating to DS metals are generally discussed herein using copper (Cu) as an example of the metal matrix material, the processes and materials discussed herein are applicable to other types of metal matrices, such as aluminum (Al), iron (Fe), and nickel (Ni), for example.

In recent years, several other methods for making DS materials have been developed . U.S. Pat. No. 4,647,304 discloses a method for mechanically forming dispersion strengthened metal powders by the use of a milling process in the presence of cryogenic materials. European Patent No. 0180144 shows a method for strengthening an aluminuim-lithium-magnesuim (Al-Li-Mg) material through the mechanical alloying of Al with carbides, oxides and silicides. European Patent No. 0184604 shows yet another method by which oxides can be formed inside a metal matrix wherein the matrix material, formed as a porous powdered-solid material with $O_2$, is placed in a high pressure casting mold together with a second molten metal. The presence of the second metal in a molten state in contact with the powdered solid leads to a chemical reaction that promotes the formation of oxides inside the matrix. All of these methods are costly because of the many processing steps involved.

U.S Pat. Nos. 4,436,559 and 4,436,560 disclose a method for the manufacture of copper base materials dispersed with boride particles. The material is intended to be electrically conductive for use in providing electrical contacts, for example, where high resistance to adhesion, wear and arcing are desired. In these patents, the size of the boride particles range from 0.1 micron to as high as 20 microns and the presence of such a large proportion of particles having sizes substantially greater than 0.1 micron does not produce an adequate dispersion strengthening effect. In addition, the boride particles as disclosed are located substantially only at, or very near, the surface portion of the copper matrix, preferably within a depth of only 0.01mm. to 1.0mm. from the surface. Such a material will not have any useful bulk strengthening properties obtained from the boride dispersion.

U.S. Pat. No. 4,440,572 discloses a method for producing alloy modified ODS copper materials, the ODS copper alloys set forth therein using only refractory oxide particles, e.g. aluminum oxide, as the dispersoid.

While other recent patents have disclosed methods for incorporating borides into non-copper matrices, they generally use relatively large size boride particles. For example, U.S. Pat. No. 4,678,510 shows a method of compacting and sintering of powders with carbon, copper and nickel boride. The particles obtained through this process have dimensions greater than 1.0 micron.

U.S. Pat. No. 4,673,550 discloses a method for preparing, milling and mixing powders that can react during the mixing to form borides. The process focuses on making other composite materials rather than making DS materials.

U.S. Pat. No. 4,677,264, shows how an electrical contact material can be manufactured using an atmospheric sintering and pressurized sintering of powders and a subsequent infiltration thereof. Through this process, pre-manufactured boride powders of about 40 microns in size are used. U.S. Pat. No. 4,693,989 discloses a method for preparing and sintering refractory metal borides of high purity, but does not deal with techniques for making DS materials.

U.S. Pat. No. 4,690,796 discloses a process for producing aluminum-titanium diboride composites, the process therein involving entraining agglomerated particles in a carrier gas that passes through a hot zone (plasma) and then resolidifying the high temperature treated particles by cooling, using an rapid solidification process (RSP) technique. The resultant material contains particles of $TiB_2$ which are generally less than 20 microns in size, but are no less than 6 microns.

All of the above processes involve numerous and costly steps which do not lead in general to the manufacture of an ultra-fine dispersoid within a DS material. It is desirable to develop better techniques which are much less tedious and time consuming and less costly, by which an ultra-fine refractory boride dispersoid can be incorporated into a metal matrix. In addition, it would be greatly advantageous if the microstructure and composition of the material produced by such a method can be tailored so as to enhance the properties required for many specific engineering applications. Moreover, such a process and the materials produced would be of considerable technological and commercial value if such materials can utilize not only a copper matrix, but also aluminum, iron and nickel matrices as well.

BRIEF SUMMARY OF THE INVENTION

This invention is a dispersion strengthened material comprising a metal matrix having ultra-fine particles of boride substantially uniformly dispersed therein, the ultra-fine boride particles having an average size of less than 0.1 micron, where the size of an ultra-fine particle, as discussed above, is deemed to mean the diameter of a sphere having a volume substantially equivalent to the volume of the particle While some boride particles dispersed in the metal may have sizes greater than 0.1 micron, little or none of the particles will be greater than 0.2 micron.

Such a DS metal material is manufactured by appropriately adapting for such purpose a currently known process, sometimes referred to as the "Mixalloy" process, described in various embodiments in U.S. Pat. Nos. 4,278,622, 4,279,843, and 4,706,730, and particularly as described in applicant's copending U.S. Pat. application, Ser. No. 219,317, filed on July 15, 1988, which application is incorporated by reference herein. Such process has never been proposed for use in producing DS materials and, in accordance with this invention, applicants are the first to have adapted the process for use in producing ultra-fine and thermally stable boride particles and dispersing them substantially uniformly throughout a metal matrix. The DS material in a molten state is then cast to produce a solidified DS material in a rapid and much simpler manner than by using any previously described processes. Moreover, the matrices of such DS materials can be easily alloyed for specific application requirements.

DESCRIPTION OF THE INVENTION

Figure 1:
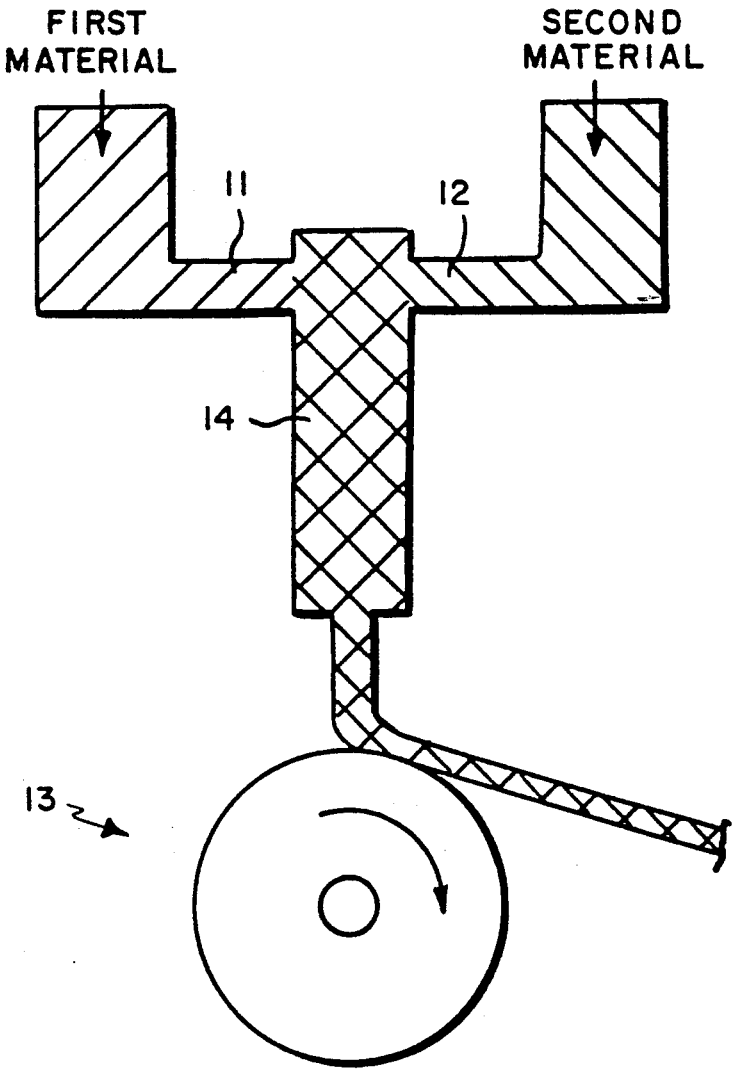
FIG. 1 shows a diagrammatic view of an apparatus for carrying out the process of the invention.

As mentioned above, most of the DS copper materials currently proposed or available utilize a refractory oxide as the dispersoid, in particular, aluminum oxide Other refractory materials such as nitrides, carbides, and borides have been largely ignored due to the difficulties encountered in processing, which difficulties generally arise because of the negligible solubility of nitrogen, carbon and boron in copper in the solid state. Such negligible solubility makes an in-situ solid state processing technique extremely difficult and thus, using conventional technologies, nitrides, carbides or borides must be extrinsically incorporated into the metal matrix.

Refractory materials such as borides, and particularly diborides formed by the transition elements, offer advantages over aluminum oxide as a dispersoid in copper or other metals. For example, Table 1, as set forth below, compares the melting point temperatures of $XB_2$, where X is titanium, zirconium, hafnium, vanadium, or niobium, with that of aluminum oxide.

TABLE 1

| Dispersoid | Melting Point Temperature (½C.) |
|---|---|
| $TiB_2$ | 2980 |
| $ZrB_2$ | 3040 |
| $HfB_2$ | 3100 |
| $VB_2$ | 2100 |
| $NbB_2$ | 2900 |
| $Al_2O_3$ | 2015 |

Such diborides have higher melting temperatures than aluminum oxide, indicating a higher thermal stability for the diborides than for aluminum oxide in a copper matrix In addition, all of such diborides (except hafnium diboride), as well as a diboride of chromium, have aluminum diboride type hexagonal structures in which the metal atoms are located on a simple hexagonal lattice, and the boron atoms occupy interstitial positions. For this reason, such compounds are very similar to metals in structure and have strong metallic properties. For example, the electrical resistivity of these diboride compounds is typically many orders of magnitude lower than that of oxides although their thermal conductivities are similar. Transition metal borides also have a positive temperature coefficient, low thermoelectric emf, and high current carrier mobility.

The dispersion strengthened material of the invention comprises a metal matrix, such as Cu, Al, Fe, or Ni, for example, within which an ultra-fine and homogenously dispersed boride dispersoid is present. Such a material can sometimes be referred to as a BDS material. The dispersoid can be selected from any boride material, but preferably is a diboride formed by the transition metals, such as $TiB_2$ and $ZrB_2$, for example, preferably having a melting point above 2000° C. and a hexagonal aluminum diboride type structure which resembles that of metals. Such borides are extremely thermally stable within the metal matrix and have strongly metallic properties The boride content of such a DS material should range from about 0.05% to about 10% by weight although for dispersion strengthening purposes, a boride content from about 0.1% to about 4% by weight is preferred. For effective dispersion strengthening, the average size of substantially all of the boride particles should not be greater than about 0.2 microns, and the average size of all of the particles should be from about 0.01 micron to about 0.1 microns. The boride dispersoid should be distributed throughout the bulk of the metal matrix in a substantially uniform fashion to provide an effective strengthening.

Although DS copper materials, particularly those using borides as the dispersoid, have good electrical conductivity and maintain high strength at high temperatures, certain properties thereof may require further enhancement for some applications. For example, in cases where both spring properties and high temperature strength are important, it is essential that the material has a high yield strength, a high resistance to stress relaxation, and a high elastic limit, in addition to strength retention ability at high temperatures. Other applications may require the material to have very high strength and electrical conductivity, in addition to the ability to retain such properties at high temperatures.

The properties of DS copper materials can be significantly altered and improved by additional alloying, i.e. by the addition of metals other than those needed to form the boride dispersoid. For example, copper-titanium alloys have good spring properties and, therefore, a copper-titanium matrix can be used to form a DS material having improved spring properties. As a further example, elements such as chromium impart high strength to copper and only slightly lower the electrical conductivity thereof. Accordingly, a copper-chromium-boride alloy can be formed to provide high strength and high electrical conductivity, as well as high strength retention after exposure to high temperatures.

Accordingly, special alloying elements can be appropriately chosen from a plurality of metals for suitably altering the properties of the matrices involved. In the case of a Cu matrix, one or more such alloying elements can be selected from the group comprising beryllium, boron, magnesium, aluminum, silicon, phosphorous, titantium, vanadium, chromium, manganese, iron, cobalt, nickel, zinc, zirconium, niobium, silver, tin, hafnium, and thorium.

In the case of aluminum, one or more such alloying elements can be selected from the group comprising beryllium, bismuth, boron, chromium, copper, iron, lead, lithium, magnesium, manganese, molybdenum, nickel, niobium, silicon, titanium, vanadium, zinc, and zirconium.

In the case of iron, one or more such alloying elements can be selected from the group comprising aluminum, boron, carbon, chromium, cobalt, copper, magnesium, manganese, molydenum, nickel, niobium, phosphorous, silicon, sulphur, tantalum, titanium, vanadium, and zirconium.

In the case of nickel, one or more alloying elements can be selected from the group comprising aluminum, beryllium, boron, carbon, chromium, cobalt, copper, iron, manganese, molybdenum, nickel, niobium, tantalum, titanium, vanadium, and zirconium.

The choice of a specific alloying element, or a particular combination of alloying elements, depends on the specific properties desired in addition to those already provided by the basic non-alloyed BDS matrix metal material (e.g. properties such as high thermal stability, high strength retention at high temperatures, and high electrical conductivity).

To be an effective modifier, the special alloying element or elements must be substantially homogenously distributed throughout the BDS matrix metal, such as copper. Because the boride particles are highly stable and do not interact with any foreign elements present in the matrix in any major way, their presence does not decrease the effectiveness of the special alloying element or elements in carrying out the latter's prescribed role of altering other properties of the BDS matrix.

Furthermore, normal secondary processing can be used on alloyed BDS materials to optimize such properties. For example, to achieve good electrical conductivity, a chromium-modified BDS copper material can be solution treated at the same temperature range used for conventional chromium-copper materials and can be cold-worked and aged at the same temperature range used for conventional binary chromium-copper materials. The resultant heat-treated BDS copper should have high strength while maintaining the desired good electrical conductivity.

The specific manufacturing process used, in accordance with the invention, to produce the above BDS materials is a novel adaptation of the Mixalloy process discussed above. FIG. 1 shows a system of the type using the Mixalloy process as generally described for example, in the afore-mentioned patents describing various embodiments of the process. In accordance therewith, a first material is supplied to an input channel 11. In adapting the process to produce materials of the invention, the first material is selected to be an alloy of X in a matrix M, where M is the matrix material and X is preferably a transition metal, e.g., Ti or Zr. A second material is supplied at input channel 12. Such material is selected to be an alloy of B in M, where B is boron in a matrix M. The materials are supplied in a molten or slurry state and injected at high pressure from channels 11 and 12 into a mixing region or chamber 14. Upon impingement of the streams of injected materials and the turbulent mixing thereof which occurs, the constituents of the mixture react in-situ to form a dispersion of ultra-fine boride particles in the matrix M.

The concentration of X in M and B in M should be such that, upon the in-situ reaction that occurs at the mixing chamber, the required concentration of borides, $XB_y$ (where y is, for example, 1 or 2), in M is obtained. The required concentration of borides will be determined by the specific application for which the material will be used.

The DS material in its molten state is then supplied to a suitable cooling device. Preferably, for example, to ensure that the ultra-fine boride particles do not agglomerate during solidification, a rapid solidification process (RSP) for casting can be used. An RSP cooling process, as used herein, means a process having a cooling rate greater than $10^3$ ° C./second. An exemplary process, for example, is shown by a chilled block melt spinner 13, such a device being well known to those in the art. The metallic ribbons resulting therefrom can be suitably cleaned, ground, and consolidated by hot extrusion, hot pressing or by any other available known technique.

During the preparation of the first and second materials, any matrix-modifier alloying elements, i.e., element Z, can be added, if desired. Such special alloying element, or elements, can be chosen to produce materials having further enhanced properties as desired and discussed above. The alloy modifier is added to the first and/or second materials in adequate proportions, taking care that, upon the addition thereof, a reaction between X and Z or B and Z does not occur.

As a specific example of the process described with reference to FIG. 1, it may be desired to manufacture a $TiB_2$ dispersion strengthened material within a matrix of Cu-Cr. In such case, an alloy of Cu-Ti-Cr is supplied in a molten state as the first material and a Cu-B alloy is supplied in a molten state as the second material. Such materials impinge and mix in mixing chamber 14 and, during the mixing, titanium diboride particles ($TiB_2$) are formed and are uniformly dispersed throughout the Cu-Cr material Because titanium diboride is more thermodynamically stable than chromium diboride, titanium diborde particles are formed rather than chromium diboride particles, and the chromium and copper together form the Cu-Cr matrix. The fine and homogenous microstructure of the mixture is then maintained by a suitable RSP casting technique, e.g. a chilled block melt spinner technique well known to the art. The metallic ribbons produced by such a casting technique can be cleaned, ground and consolidated by hot extrusion, hot pressing or by any one of a number of known techniques.

Figure 2:
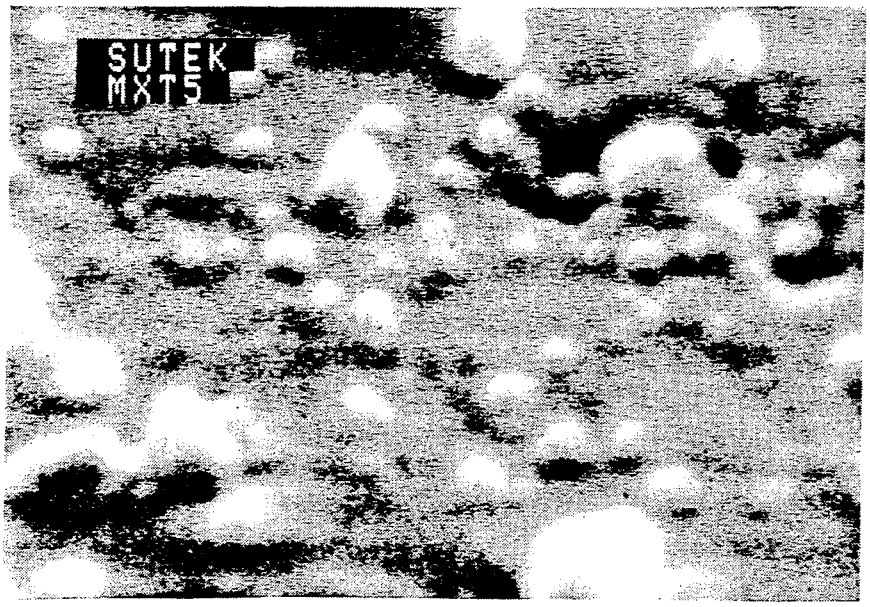
FIG. 2 shows a microphotograph of a portion of the microstructure of a particular embodiment of the invention.

FIG. 2 shows a reproduction of a microphotograph of a portion of the microstructure of a specific BDS copper material produced by the process discussed above with reference to FIG. 1. FIG. 2 demonstrates the homogenous distribution of ultra-fine $TiB_2$ particles in a copper matrix achieved by appropriately adapting the Mixalloy process for such purpose together with an RSP cooling technique, for example. In such case the particles are generally spherical and the average diameter of all particles is less than 0.1 micron, substantially all of the particles having equivalent diameters of less than 0.2 microns.

Figure 3:
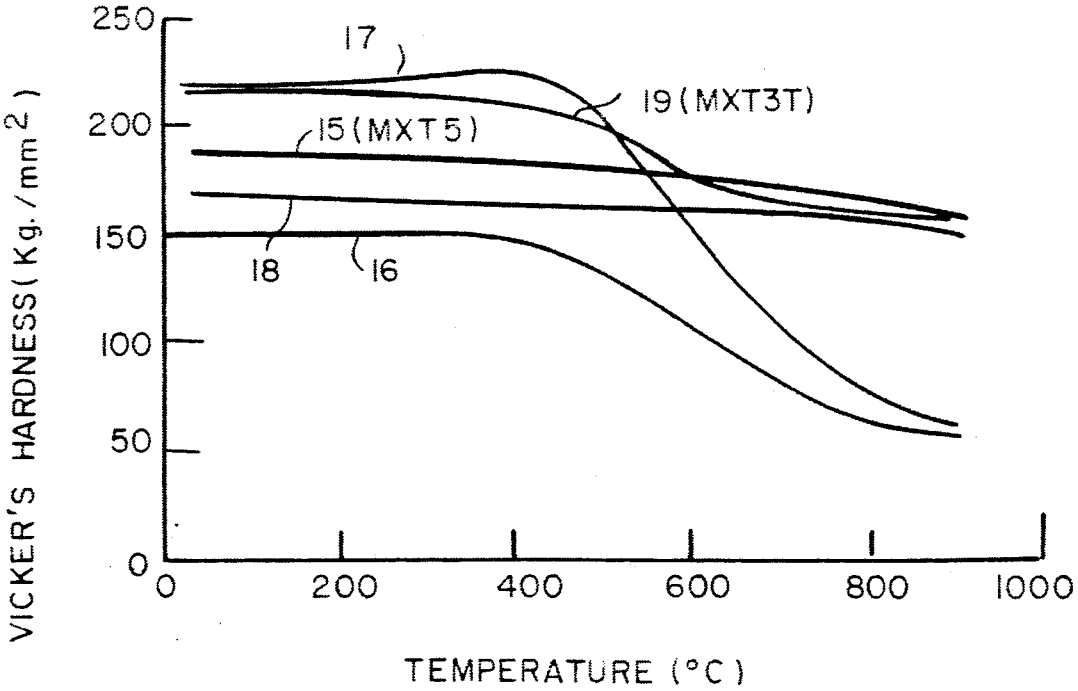
FIG. 3 shows a graph depicting curves of hardness as a function of temperature for various materials including exemplary materials of the invention.

One specific example of a titanium diboride DS copper material, which has been produced using the Mixalloy process as described above, is a material in which the $TiB_2$ dispersoid is 2.2% by weight of the overall material. Table 2, attached hereto, compares the mechanical properties and electrical conductivity of such a material (identified as MXT5) with those properties of conventional high performance copper alloys such as copper-chromium (identified as CDA182), copper-beryllium (CDA175), copper-zirconium (CDA150), and a $Al_2O_3$ DS Copper (Al-60). FIG. 3 shows a comparison of the Vickers room temperature hardness of the BDS copper (MXT5) material (curve 15) with those of certain conventional and known materials such as Cu-Cr (curve 16), Cu-Be (curve 17) and $Al_2O_3$-Cu (curve 18). The thermomechanical treatments for curves 15, 16 17, and 18 are described in Table 2. In each case, a number of samples of a particular material are separately exposed for one hour to a different temperature. After cooling quickly to room temperature, the hardnesses are determined to produce the curves shown. The BDS copper has excellent thermal stability due to the extremely stable $TiB_2$ particles. The conventional coppers, on the contrary, tend to lose their thermal stability above about 600° C. due to coarsening and solutioning of their precipitated phases, while the $Al_2O_3$-Cu tends to hold its stability.

Another exemplary embodiment of the invention using an alloy of copper as the matrix material is one having a 1.5% by weight of titanium diboride and a 1.2% weight of titanium. This DS alloyed copper material is prepared in accordance with the method of the invention as previously described. FIG. 3 shows the Vickers room temperature hardness of such a DS alloy (identified as MXT3T) as curve 19 therein, after exposure of samples thereof to different temperatures, each for one hour. Both the MXT5 and the MXT3T materials were cold rolled with intermediate annealings to a comparable degree of reduction prior to annealing tests and hardness measurements. Although thermomechanical treatments were not optimized for the titanium-alloyed MXT3T material, such material provided an increased hardness of about 15% over that of the unalloyed MXT5 material, even though the unalloyed material has a higher boride content than the alloyed material Furthermore, the dispersion-strengthened nature of the titanium-alloyed copper is maintained over a wide temperature range there being little or no substantial loss of hardness of the material even after exposure to as high a temperature as 900° C. (0.86 of its melting point temperature Tm). The titanium-alloyed DS copper combines the strengthening effect from the titanium at low temperature and the stabilizing effect of the boride dispersion at high temperature. Spring properties are also improved dramatically since copper-titanium is a good spring material. However, improvement in the strength of the titanium-alloyed DS copper is gained at the expense of some loss in electrical conductivity, 25% IACS of the titanium-alloyed copper vs 80% of IACS of the unalloyed DS copper.

In order to gain high strength while still maintaining good electrical conductivity, different alloying elements other than titanium can be used. For example, chromium and zirconium are good candidates for the alloying elements for such purpose. One example thereof would be a material having a 0.5% by weight of zirconium, 0.6% by weight of chromium, and 1.7% by weight of zirconium diboride copper alloy, such material exhibiting much higher hardness values than those of a binary alloy, such as copper-zirconium, copper-chromium, or copper zirconium boride. After solution annealing, cold rolling, and peak aging, a room temperature Vickers hardness value of 210 can be obtained on a zirconium and chromium modified zirconium diboride copper alloy. For comparison, wrought zirconium copper, chromium copper, and zirconium diboride DS copper all exhibit Vickers hardness values in the 140–160 range. At the same time, a high electrical conductivity value of 77% IACS is maintained. This compares favorably with the 88%, 80% and 85% of zirconium copper, chromium copper, and zirconium boride DS copper, respectively.

In another exemplary embodiment of the invention, the addition of 0.16% by weight of manganese to zirconiom diboride DS copper results in a modest increase in hardness but with a minimum degradation of electrical conductivity. The addition of such a small amount of manganese increases the Vickers hardness of the alloyed BDS copper to about 160 from 150 for a 1.7% by weight zirconium boride DS copper material. The conductivity drops from 85% IACS for the unalloyed DS copper to 82% IACS for the manganese modified BDS copper.

In general the choice of the matrix and the special alloying elements is made according to intended application of the material. The resultant alloy modified BDS copper materials can then have unique combinations of properties that are attributable to both the special alloying elements and to the ultra-fine boride dispersion elements.

An addition of 10% by weight of aluminum plus 4% by weight of nickel, or 50% by weight of manganese can be used to improve the damping characteristics of BDS copper. In boride DS aluminum an addition of 20% by weight of silicon can improve strength and wear resistance. The resultant alloy should also have a low thermal coefficient of expansion. In boride DS iron, an addition of 18% by weight of chromium and 8% by weight of nickel can be added to form essentially an austenitic stainless steel matrix. A BDS stainless steel will have superior corrosion and oxidation resistance, and better creep properties than plain BDS iron. Similarly, the oxidation and creep resistance of BDS nickel can be further improved by the addition of about 16% by weight of chromium. Other alloying elements of interest could be combined with boride DS materials in a similar manner to tailor properties of the materials to the specific applications.

Moreover, although the embodiments of the BDS materials discussed above each utilize a matrix having ultra-fine particles of a single refractory boride dispersed therein, it is clear that a matrix of such materials can also have ultra-fine particles of more than one different types of refractory borides dispersed therein.

Accordingly, boride DS materials having various desired properties can be made in accordance with the invention and the invention is clearly not limited to the particular exemplary embodiments described above except as defined by the appended claims.

TABLE 2

Mechanical and Electrical Properties of $TiB_2$ DS Copper (MXT5) and Selected High Performance Copper Alloys

| Material | Metallurgical Treatment | 0.2% Yd Strength MPa (ksi) | Tensile Strength MPa (ksi) | Elong. % | Electrical Conductivity % IACS |
|---|---|---|---|---|---|
| $TiB_2$ DS Copper (MXT5) | Cold Rolled 95% | 617 (89.5) | 672 (97.5) | 7 | 76 |
| $Al_2O_3$ DS Copper (Al-60) | Cold Drawn 60% | 579 (84.0) | 604 (87.5) | 10 | 78 |
| CuBe (CDA 175) | Cold Worked to full hard & age hardened | 698–825 (100–120) | 760–895 (110–130) | 8–15 | 50–60 |
| CuCr (CDA 182) | Cold Worked to full hard & age hardened | 450 (65) | 530 (77) | 16 | 80 |
| CuZr (CDA 150) | Cold Worked 80% & age hardened | 440 (64) | 470 (68) | 11 | 90 |

What is claimed is:

1. A dispersion-strengthened material comprising a metal matrix M where M is a metal selected from the group consisting of aluminum, copper, and nickel, a plurality of ultra-fine particles of at least one refractory boride $XB_y$ substantially homogeneously dispersed in said metal matrix, where $XB_y$ is a boride formed as a reaction product of boron and a metal X which reacts with boron and y is an integer, said particles having an average particle size of less than 0.1 microns with substantially few or no particles having an average size greater than 0.2 microns, and said at least one boride being within a range of about 0.05% to about 10% by weight of the dispersion-strengthened material.

2. A dispersion-strengthened material in accordance with claim 1 wherein said at least one refractory boride is a boride formed as the reaction product of boron and X is a transition element.

3. A dispersion-strengthened material in accordance with claim 2 wherein said transition element X is selected to be an element selected from the group consisting of titanium and zirconium.

4. A dispersion-strengthened material in accordance with claim 1 wherein said metal matrix M further includes one or more modifier elements Z to form a modified matrix M-Z.

5. A dispersion-strengthened material in accordance with claim 4 wherein said metal matirx M is copper and said one or more modifier elements Z are selected from the group consisting of beryllium, boron, magnesium, aluminum, silicon, phosphorous, titanium, vanadium, chromium, manganese, iron, cobalt, nickel, zinc, zirconium, niobium, silver, tin, hafnium, and thorium.

6. A dispersion-strengthened material in accordance with claim 4 wherein said metal matrix M is aluminum and said one or more modifier elements Z are selected from the group consisting of beryllium, bismuth, boron, chromium, copper, iron, lead, lithium, magnesium, manganese, molybdenum, nickel, niobium, silicon, titanium, vanadium, zinc, and zirconium.

7. A dispersion-strengthened material in accordance with claim 4 wherein said metal matrix M is nickel and said one or more modifier elements are selected from the group consisting of aluminum, beryllium, boron, carbon, chromium, cobalt, copper, iron, manganese, molybdenum, nickel, niobium, tantalum, titanium, vanadium, and zirconium.

8. A dispersion-strengthened material in accordance with claim 4 wherein the metal matrix M is copper and the modifier element Z is titanium.

9. A dispersion-strengthened material in accordance with claim 8 wherein said modifier element is 1.2% by weight of titanium.

10. A dispersion-strengthened material in accordance with claim 4 wherein the metal matrix M is copper and the modifier elements Z are selected from the group consisting of zirconium and chromium.

11. A dispersion-strengthened material in accordance with claim 10 wherein said modifier elements include 0.5% by weight of zirconium and 0.6% by weight of chromium.

12. A dispersion-strengthened material in accordance with claim 4 wherein the metal matrix M is copper and the modifier element Z is manganese.

13. A dispersion-strengthened material in accordance with claim 12 wherein said modifier element is 0.16% by weight of manganese.

* * * * *